US005769675A

United States Patent [19]

Takahashi et al.

[11] Patent Number: 5,769,675

[45] Date of Patent: Jun. 23, 1998

[54] COMPONENT LAYOUT FOR AN OUTBOARD MOTOR

[75] Inventors: Masanori Takahashi; Hitoshi Watanabe, both of Hamamatsu, Japan

[73] Assignee: SanshinKogyo Kabushiki Kaisha, Hamamatsu, Japan

[21] Appl. No.: 703,008

[22] Filed: Aug. 26, 1996

[30] Foreign Application Priority Data

Aug. 30, 1995 [JP] Japan ..... 7-222215

[51] Int. Cl.[6] ..... B63H 5/13

[52] U.S. Cl. ..... 440/83; 440/75

[58] Field of Search ..... 440/75, 78, 83, 440/900, 53; 123/195 P

[56] References Cited

U.S. PATENT DOCUMENTS

| | | | |
|---|---|---|---|
| 1,903,350 | 4/1933 | Landrum | 440/75 |
| 3,025,822 | 3/1962 | Tenney | 440/75 |
| 4,173,939 | 11/1979 | Strang | 440/75 |
| 4,343,612 | 8/1982 | Blanchard | 440/75 |
| 5,309,877 | 5/1994 | Shigedomi et al. | 440/900 |

*Primary Examiner*—Ed L. Swinehart

*Attorney, Agent, or Firm*—Knobbe, Martens, Olson & Bear LLP

[57] ABSTRACT

A number of embodiments of outboard motors having power head and drive configurations that permit the engine to be mounted so that its crankshaft is offset from the drive shaft so as to facilitate larger turning angles without interference.

13 Claims, 10 Drawing Sheets

COMPONENT LAYOUT FOR AN OUTBOARD MOTOR

BACKGROUND OF THE INVENTION

This invention relates to a component layout for an outboard motor and more particularly to an improved relationship between the output shaft of the powering engine and the propulsion device input shaft that provides a more compact assembly that permits a wider latitude of movement of the outboard motor without obstruction from the associated watercraft.

As is well known, the conventional outboard motor is comprised of a power head that contains a powering internal combustion engine and a surrounding protective cowling. As is typical with outboard motor practice, the engine is normally supported so that its output shaft rotates about a vertically extending axis. This is done to facilitate the coupling of the engine output shaft to a drive shaft that is journaled within a drive shaft housing and lower unit that depends from the power head. A propulsion device has a transmission input shaft that is driven directly by this drive shaft and which propels an associated watercraft. The outboard motor and specifically the drive shaft housing normally has attached to it a steering shaft that is journaled in a swivel bracket for steering of the outboard motor about a vertically disposed axis. Frequently, the swivel bracket is coupled to the transom of the watercraft through a pivotal connection so as to also permit tilt and trim movement.

Obviously, the drive shaft is normally positioned to the rear of the steering shaft. Because of the utilized direct connection between the engine output shaft and the drive shaft, this means that the position of the engine itself is quite heavily biased to a rearward position. That is, the engine output shaft generally rotates about an axis that is disposed also to the rear of the steering shaft. This gives rise to certain space constraints which may be best understood by reference to FIGS. 1–3 which are illustrations of conventional constructions of the type which present the problems aforenoted.

Referring first to FIG. 1, this shows a conventional type of watercraft hull, indicated generally by the reference numeral 21 which has any known type of configuration. However, the hull 21 generally has a transom 22 that defines a recessed area 23 centrally therein which is bounded by a pair of side walls 24 and a front wall 25.

In the illustrated prior art example, the watercraft 21 is powered by a pair of outboard motors 26 that are mounted in the recess 23 in a manner which will be described. The background prior art is described in conjunction with a marine propulsion system that employs a pair of outboard motors, such as the outboard motors 26, because this is a relatively convenient way in which to describe the problems of the prior art constructions. As will become apparent, however, the invention is not limited to the utilization of the concept with a pair of outboard motors, but can be utilized with a single outboard motor.

Referring now primarily to FIGS. 2 and 3, the construction of each of the conventional type outboard motor 26 will be described as will their attachment to the watercraft hull 21. Each outboard motor 26 is comprised of a power head, indicated generally by the reference numeral 27, which is comprised primarily of a powering internal combustion engine 28 and a surrounding protective cowling 29. In the illustrated prior art construction, the engines 28 are depicted as being of the V-type and, specifically, constitute V-6 engines. Also, the engines are constructed and operated in accordance with a four-cycle principle.

Although such engines are depicted and will be described, it will be readily apparent to those skilled in the art that the problems referred to also exist with engines of other configurations. However, the invention has particular utility in solving problems particularly prevalent with V-type engines because of the width of such engines in relation to their output shaft axis.

Each engine 28 is comprised of a cylinder block, indicated generally by the reference number 31 which forms a pair of cylinder banks in which individual cylinder bores are formed. Considering the V-6 example, each cylinder bank is formed with three cylinder bores having vertically spaced axes which extend in horizontal planes.

Cylinder heads 32 are affixed to the cylinder banks of the cylinder block 31 in closing relationship thereto. In a typical four-cycle engine, the cylinder heads may contain overhead camshafts and overhead valves which are contained within cam covers 23. Such a construction will be described later in connection with the embodiments of the invention.

The cylinder bores of the cylinder banks contain pistons that are connected by connecting rods in a known manner to drive a crankshaft 34. The crankshaft 34 rotates about a generally vertically disposed axis.

As has been previously noted, the vertical disposition of the axis of the crankshaft 34 permits its convenient coupling to a drive shaft 35 that depends into a drive shaft housing 36 and which is journaled therein in any known manner. The drive shaft housing 35 also includes a lower unit 37 which may be formed integrally with or as a separate component from the drive shaft housing 36. This lower unit journals a propeller shaft (not shown) to which a propeller 38 is affixed for rotation in known manner. A forward-neutral-reverse transmission, generally of the bevel gear type, incorporates an input pinion gear shaft 39 which is driven from the drive shaft 35 and which can selectively drive the propeller 38 in forward or reverse directions for propelling the associated watercraft 21.

Each drive shaft housing 36 has a steering shaft 41 affixed to it forwardly of the drive shaft 35 and external of its outer housing. The steering shaft 41 is affixed to the drive shaft housing 36 by a upper and lower brackets 42 in a manner that is generally known in the art. The steering shaft 41 is supported for steering movement of the outboard motor 26 within a swivel bracket 43 in a known manner. The swivel bracket 43 is pivotally connected by means of a pivot pin 44 to a clamping bracket 45. The clamping bracket 45 is connected to the transom 22 in a known manner and particularly to an upstanding ledge 46 thereof that extends into the recess 23. This pivotal connection permits tilt and trim movement of the outboard motors 26 about the axis defined by the pivot pin 44. In addition, the outboard motors 26 may be tilted up to and out of the water position for trailering or other purposes as shown in the phantom line view of FIG. 3.

When twin outboard motors are employed, their steering mechanism usually includes a connecting link 47 that is pivotally connected between the tiller mechanisms or some other portion of the outboard motors 26 so that they will be pivoted in unison about the steering axes defined by the steering shaft 41 as shown in the phantom line views of FIG. 1.

The problems attendant with the prior art type of construction are revealed by inspection of FIG. 2 which shows the outboard motors 26 steered to a position wherein a right turn is being executed. It will be seen that the degree of pivotal movement indicated by the angle θ is limited because of the width of the engine 27 and, specifically, because of the fact that the V-cylinder banks are disposed quite rearwardly from the steering axis defined by the steering shaft 41. Not only does this cause interference with the side walls 24 of the recess, but it can cause interference between the two adjacent outboard motors 26 when two of them are placed in side-by-side relationship.

It is, therefore, a principal object of this invention to provide an improved an compact configuration arrangement for an outboard motor.

It is a further object of this invention to provide an arrangement for an outboard motor wherein the components are positioned so as to provide a larger degree of pivotal movement than with conventional structures.

The concept can be recognized by viewing the phantom line views of outboard motors shown at 51 in FIG. 2 and which represent the concept of this invention. Basically, the concept is such that the outboard motor and, particularly, its power head 27 is moved forwardly relative to the steering axis defined by the steering shaft 41. As may be seen, if this can be accomplished, then a larger angle of movement is possible without interference.

SUMMARY OF THE INVENTION

This invention is adapted to be embodied in an outboard motor that is comprised of a power head containing an internal combustion engine having at least one combustion chamber containing an element driven by combustion in the combustion chamber. An engine output shaft is drivably coupled to the element for effecting rotation of the engine output shaft about a generally vertically disposed axis when the engine is running. A protective cowling encircles the engine and completes the power head. A drive shaft housing and lower unit depends from the power head and contains a propulsion device for powering an associated watercraft. The propulsion device has a transmission input shaft that is rotatable about a generally vertically disposed axis. A steering shaft is connected to the drive shaft housing and lower unit and is journaled for steering movement about a vertically disposed steering axis for steering of the outboard motor and the associated watercraft. The transmission input shaft is disposed to the rear of the steering shaft axis. In accordance with a feature of the invention, the engine output shaft is offset from the transmission input shaft.

DETAILED DESCRIPTION OF THE PREFERRED EMBODIMENTS OF THE INVENTION

Figure 2:
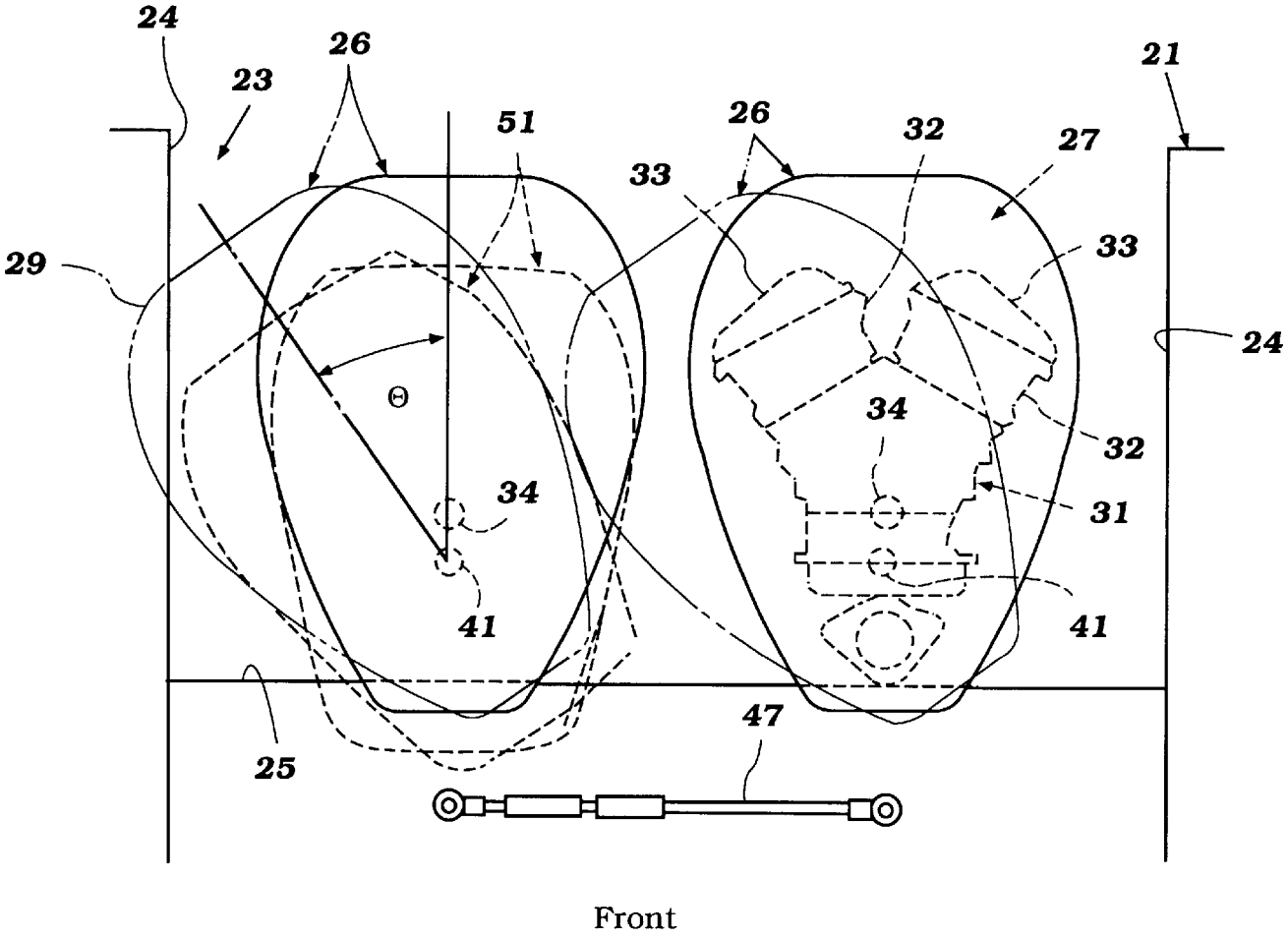
FIG. 2 is a top plan view showing the rear portion of the watercraft illustrated in FIG. 1 and depicts the problem in limitation of steering degree with the prior art type of construction, and also shows, in phantom, a concept by which the problem can be solved in accordance with the invention.

Referring now in detail to the drawings, and initially to the embodiment of FIGS. 4–7, an outboard motor constructed in accordance with this embodiment is identified generally by the reference numeral 51, that utilized in the description of FIG. 2 to illustrate how the invention solves the problem of the prior art constructions. Like the prior art constructions, the outboard motor 51 consists of the same principal components, although their orientation, particularly that of the engine and its drive for the propulsion unit, is different. These components include a power head, indicated generally by the reference numeral 52, which is comprised of a powering internal combustion engine 53 and a surrounding protective cowling 54. The engine 53 is configured and mounted in such a way so that its crankshaft 55 rotates about an axis 56 which is disposed well forward of those of the prior art.

Figure 1:
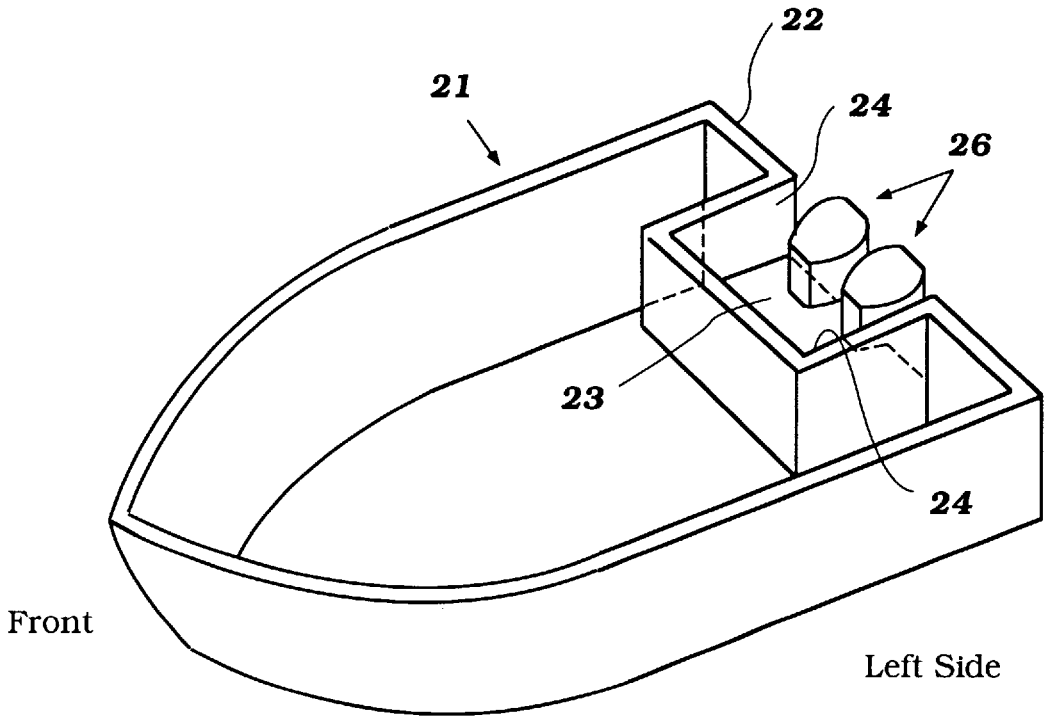
Figure 1 Prior Art
FIG. 1 is a perspective view taken from above and the front, showing a conventional type of watercraft having a dual propulsion system embodying outboard motors constructed in accordance with the prior art.
Figure 3:
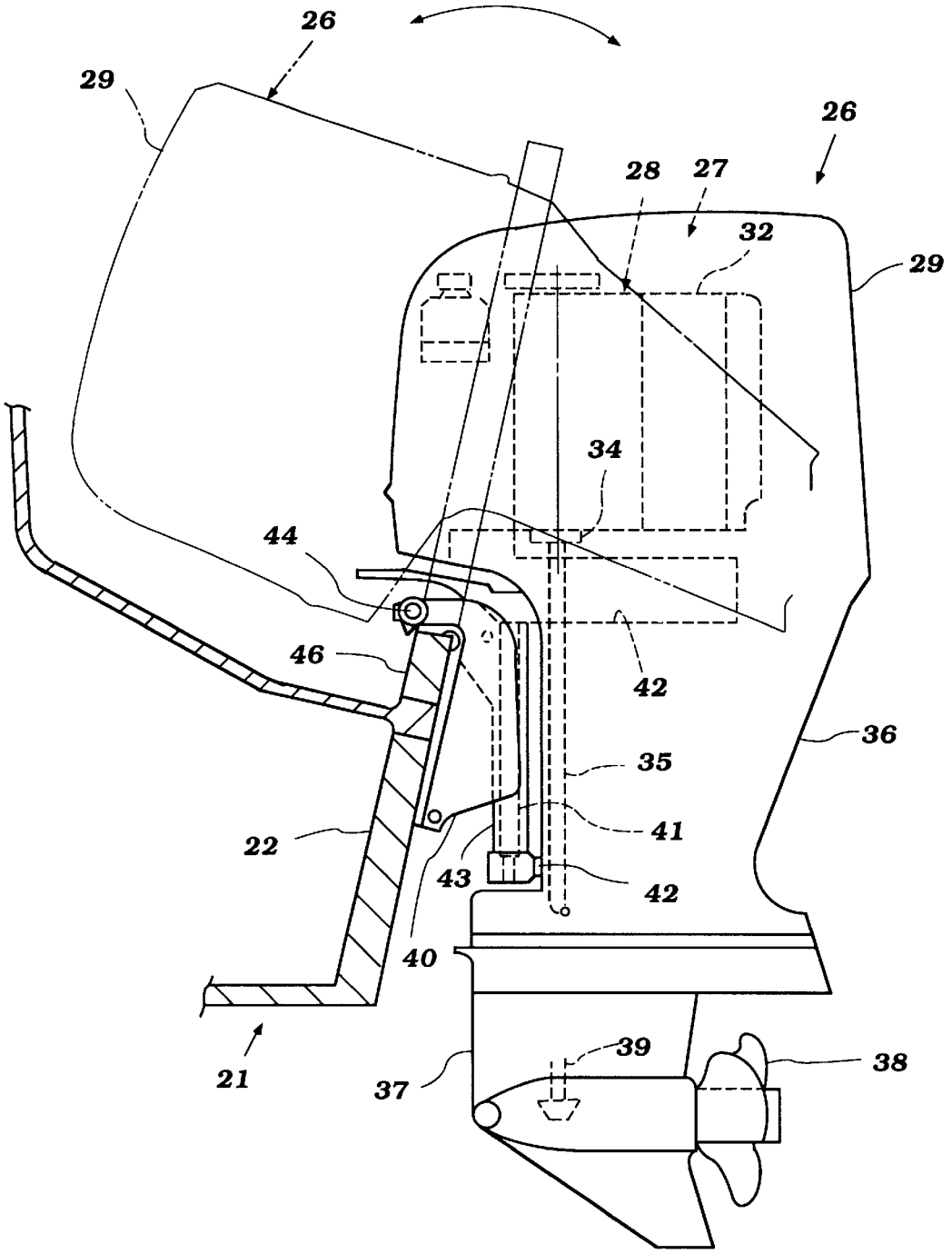
Figure 3 Prior Art
FIG. 3 is a side elevational view of the prior art watercraft showing the outboard motors in normal running condition in solid lines and tilted up in phantom line.

This crankshaft 55 has a spur or helical gear 57 affixed to it which is enmeshed with a further spur or helical gear 58 that is affixed to the upper end of a drive shaft 59. Like the prior art constructions, the drive shaft 59 is rotatably journaled within a drive shaft housing and lower unit assembly 61. This unit 61 includes a lower unit 62 in which a bevel gear reversing transmission 63 is provided for driving a propeller shaft 64. A propeller 65 is affixed to this propeller shaft 64 and provides propulsion force to the associated watercraft 21. The reference numerals previously referred to in FIGS. 1–3 applying to the watercraft 21 are carried over here. Although the same reference numerals are applied, it will be apparent that the construction of the outboard motor 51 permits the use of a smaller recess 23, regardless of whether one or two outboard motors are contained therein. The reason for this will be described later by reference primarily to FIG. 5 and reference back to FIG. 2.

Although the reversing transmission 63 may be of any known type, it includes an input shaft 66 on which a bevel gear 67 is affixed. This input shaft 66 is coaxial with the drive shaft 59, but is disposed well to the rear of the crankshaft rotational axis 56.

Like the conventional type of outboard motor, a steering shaft 41 is carried by the drive shaft housing 61 by lower and upper brackets 42. This steering shaft 41 is journaled for rotation within a swivel bracket 43. The swivel bracket 43 is connected by means of the pivot pin 44 to the clamping bracket 45. Thus, the outboard motor 51 is supported for steering and tilt and trim movement, as with the conventional type of outboard motor.

A tiller 68 is affixed to the upper end of the steering shaft 41 and is steered in a known manner. A tie rod 69 (FIG. 5)

is connected between the two outboard motors so that they will be steered simultaneously.

A hydraulic tilt and trim unit 70 which is interposed between the clamping bracket 45 and swivel bracket 43 for controlling the trim and tilt condition of the outboard motor 51 in a manner well known in this art. The unit 70 also may permit the outboard motor 51 to pop up when an underwater obstacle is struck.

Figure 5:
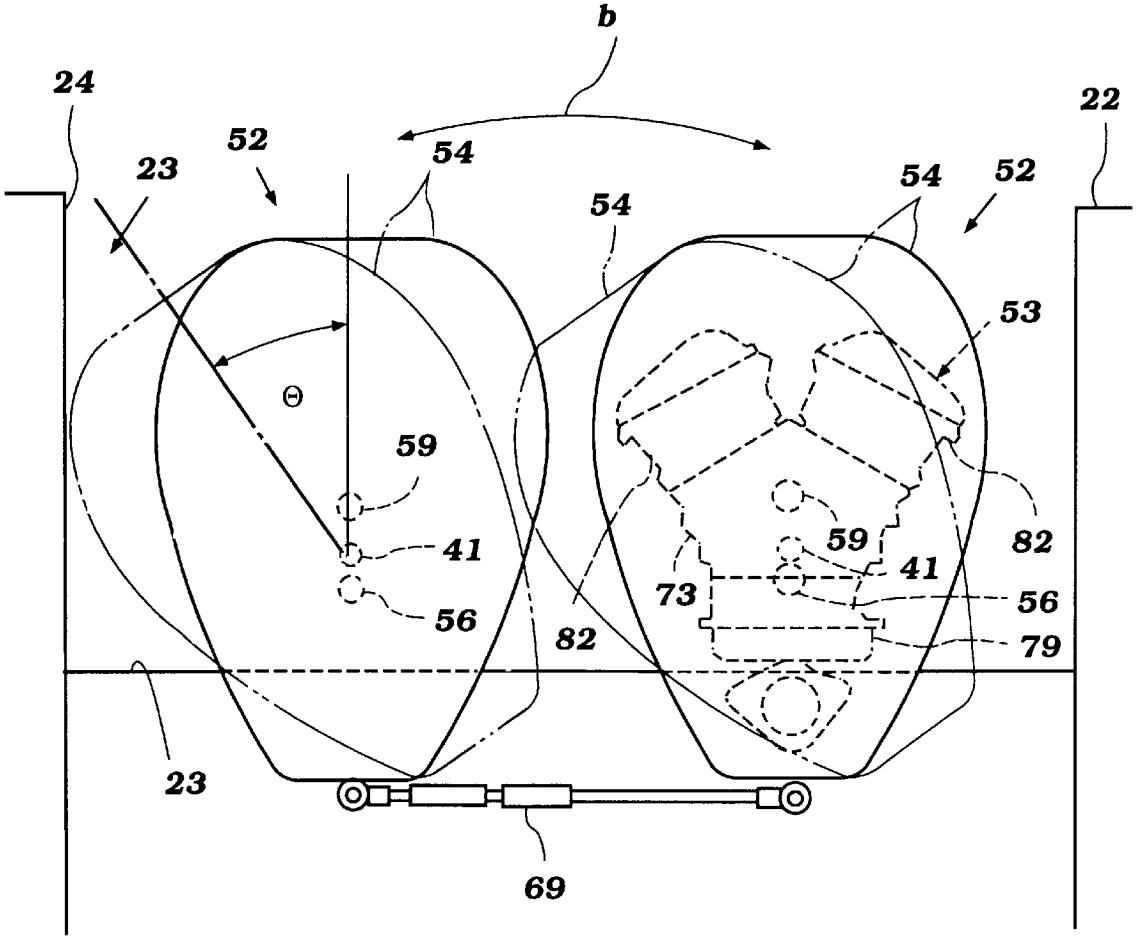
FIG. 5 is a top plan view, in part similar to FIG. 2, and shows how this embodiment accomplishes the features of the invention.

As may be best seen in FIG. 5, since the crankshaft axis 56 is forward of the axis of the steering shaft 41, it is possible to move the entire power head 52 forwardly so that a greater degree of pivotal movement 0 is possible without interference with the side walls 24 of the hull 21 or without interference between the two outboard motors 52. Thus, it is possible to obtain a much more compact assembly and still permit the use of a V-type engine.

The construction of the engine 53 will now be described in more detail, referring first primarily to FIGS. 6 and 7. As has been noted, the engine 53 is of the V-6 type and, accordingly, its cylinder block 71 is formed with a pair of angularly related cylinder banks, each of which is formed with a plurality of horizontally extending cylinder bores 72. These cylinder bores 72 may be formed from thin liners that are either cast or otherwise secured in place in the cylinder block 71. Alternatively, the cylinder bores 72 may be formed directly in the base material of the cylinder block 71. Where light alloy castings are employed for the cylinder block 71, however, such liners are preferred. In the illustrated embodiment, the engine 53 is, as noted, of the V-6 type, and hence, each cylinder bank, indicated by the reference numeral 73, is formed with three cylinder bores 72. The cylinder bores 72 of the cylinder bank 73 are preferably staggered relative to each other.

Pistons 74 are supported for reciprocation in the cylinder bores 72. Piston pins 75 connect the pistons 74 to respective connecting rods 76. The connecting rods 76, as is typical in V-type practice, may be journaled in side-by-side relationship on a common throw 77 of the crankshaft 55. That is, pairs of cylinders, one from each cylinder bank 73, may have the big ends of their connecting rods 76 journaled in side-by-side relationship on a common crankshaft throw 77. This is one reason why the cylinder bores 72 of the cylinder bank 73 are staggered relative to each other. In the illustrated embodiment, however, separate throws 77 are provided for the cylinders of each bank. The throw pairs are nevertheless disposed between main bearings of the crankshaft to maintain a compact construction.

The crankshaft 55 is journaled, as previously noted, for rotation about a vertically extending axis within a crankcase chamber 78, formed by a crankcase member 79 and a skirt 81 of the cylinder block 71. This manner of journaling may be of any type known in the art.

Each cylinder bank 73 is closed on the end opposite to the crankcase chamber 78 by a respective cylinder head 82. The cylinder heads 82 are provided with individual recesses 83 which cooperate with each of the cylinder bores 72 and the heads of the pistons 74 to form the combustion chambers. These recesses 83 are surrounded by a lower cylinder head surface that is held in sealing engagement with either the cylinder block cylinder banks 73 or with cylinder head gaskets interposed therebetween, in a known manner. These planar surfaces of the cylinder head may partially overlie the cylinder bores 72 to provide a squish area, if desired. The cylinder heads 82 are affixed in any suitable manner to the cylinder block banks 73.

Because of the angular inclination between the cylinder banks 73 and as is typical with V-type engine practice, a valley is formed between the cylinder heads 82 and in part between the cylinder banks 73. An induction system for the engine, indicated generally by the reference numeral 84, is positioned in part in this valley.

This induction system includes intake passages 85 which extend from a surface 86 of the cylinder heads 82 to valve seats formed in the combustion chamber recesses 72. The arrangement may be such that either a single intake passage and port is formed for each combustion chamber recess 72 or, alternatively, there may be multiple valve seats.

Poppet-type intake valves 87 are slidably supported in the cylinder heads 82 in a known manner, and have their head portions engagable with these valve seats so as to control the flow of the intake charge into the combustion chambers through the intake passages 85. The way in which the charge is delivered to these intake passages 85 by the induction system 84 will be described in more detail subsequently.

The intake valves 87 are urged toward their closed positions by coil compression springs (not shown). These valves are opened by intake camshafts 88 which are journaled in the cylinder head assemblies 82 in a suitable known manner. The intake camshafts 88 are driven from the crankshaft 55 by a drive, which will also be described in more detail later, primarily by reference to FIG. 7. The intake camshafts 88 have cam lobes which operate the valves 87 through thimble tappets 89.

On the outer side from the valley 73, each cylinder head 82 is formed with one or more exhaust passages 91. The exhaust passages 91 emanate from one or more valve seats formed in the cylinder head recesses 72, and cooperate with exhaust systems that include exhaust manifolds, indicated generally by the reference numeral 92, for discharge to the atmosphere through any known type of exhaust system as used in outboard motors.

Exhaust valves 93 are supported for reciprocation in the cylinder heads 82 in a manner similar to the intake valves 87. These exhaust valves 93 are urged toward their closed positions by coil compression springs (not shown). The exhaust valves 93 are opened by overhead mounted exhaust camshafts 94, which are journaled for rotation in the cylinder heads 82, in a known manner. The rotational axes of the intake camshafts 88 and exhaust camshafts 94 are parallel to each other. The exhaust camshafts 94 have cam lobes that cooperate with thimble tappets 95 for operating the exhaust valves 93 in a known manner. Like the intake camshafts 88 the exhaust camshafts 94 are driven from the crankshaft 55 in a manner which will be described.

The valve actuating mechanism as thus far described is contained within cam chambers 96 formed by each cylinder head 82 and closed by cam covers 97 that are fixed to the cylinder heads 82 in a known manner.

The induction system 84 for the engine 53 will now be described again by primary reference to FIG. 6. As is typical with outboard motor practice, the protective cowling 54 with air inlet openings (not shown) preferably configured so as to permit copious amounts of air to flow into the interior of the protective cowling 54 while at the same time precluding or substantially precluding water entry. Any of the known inlet type devices can be utilized for this purpose.

In conjunction with the induction system for the engine, it is desirable to provide a relatively large plenum area that supplies the individual cylinders through respective runners. The use of a plenum area is desirable so as to minimize the interference from one cylinder to the others. This presents a particular space problem, particularly in conjunction with outboard motors where space is obviously at a premium.

Therefore, the induction system 84 is designed so as to provide a large plenum volume and still maintain a compact construction. Furthermore, the construction is such that servicing of the engine is not significantly affected.

The air which enters the protective cowling flows into an air inlet device (not shown) which preferably faces forwardly away from the cowling inlet opening. This, in effect, provides a circuitous path of air flow which assists in separation of water from the inducted air. The air inlet device serves a throttle body (also not shown). The throttle body is affixed to a Y pipe (not shown) having branches each of which extends to a respective plenum chamber 100. The plenum chambers 100 overlie the respective cam covers 97 and are suitably mounted thereon. The plenum chambers 97 extend substantially the full length of the respective cylinder banks 73, and thus provide a fairly substantial volume for the inducted air.

Each plenum chamber 100 has a plurality of runners, one for each cylinder of the opposite cylinder bank 73, these runners being indicated by the reference numeral 98. The runners 98 extend transversely across the upper portion of the engine valley area 73 and then turn downwardly so as to communicate with respective passages formed in direct alignment with the cylinder head intake passages 85 of the respective cylinder head.

Thus, this arrangement provides not only a large effective plenum chamber volume, since each plenum chamber 100 serves only three cylinders, but also provides relatively long runners 98 that extended from the plenum chamber volumes 100 to the cylinder head intake passages 85. Thus, the length of these runners 98 can be tuned relative to the volume so as to provide the desired charging effect in the induction system. The described arrangement with the long runners 98 is particularly effective at mid-range speeds.

In the illustrated embodiment, the engine 53 is provided with a manifold-type fuel injection system. This fuel injection system includes a plurality of fuel injectors 99, one for each cylinder head intake passage 85. These fuel injectors 99 are disposed in the area between the re-entrant portions of the manifold runners 98 and hence, are protected by these runners, since they are partially surrounded by them, while at the time being accessible. In addition, air flow over the injectors 99 is possible so as to cool the injectors along with the air flowing through the runners 98. Preferably, the injectors 99 are of the electrically operated type embodying solenoid actuated valves, and hence, there is some heat generated associated with their operation.

Figure 6:
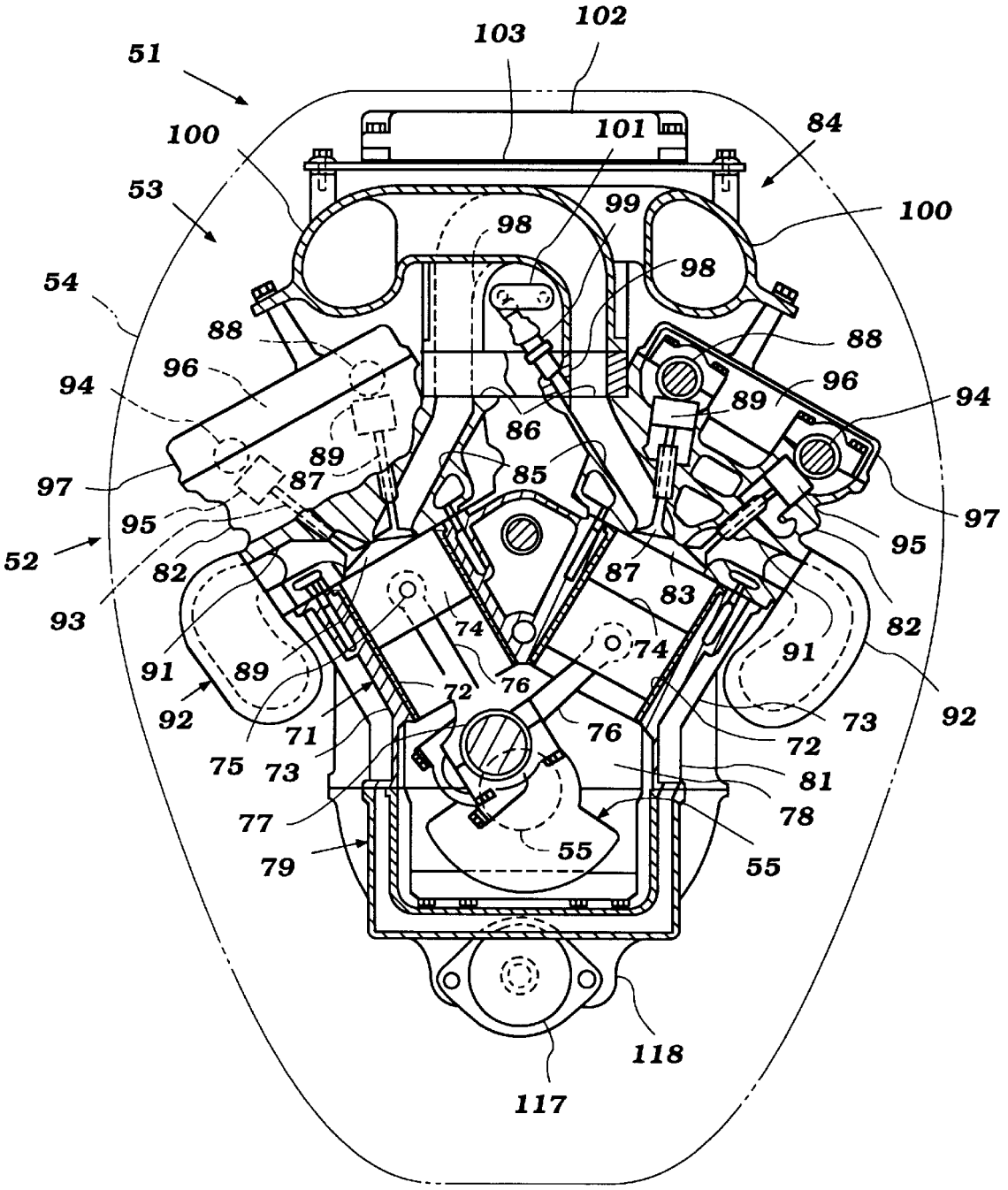
FIG. 6 is a top plan view of the outboard motor, with the protective cowling shown in phantom and portions of the engine broken away to show the internal construction of the engine.

The injectors 99 for the respective cylinder banks are mounted in general alignment with the cylinder head intake passages 85, as best seen in FIG. 6. Hence, the spray from the injectors 99 can easily mix with the air flowing into the combustion chamber so as to provide a good mixture distribution.

The injectors 99 have their inlet tip portions received in a fuel rail 101 that extends vertically through the area encompassed by the runners 98 and also protected by them. The fuel rail 101 has two flow passages, one for the injectors 99 of each bank so that the flow passages are in side-by-side relationship and accommodate the crossed-over relationship of the injectors 99 when viewed in top plan. A suitable fuel supply system is provided for supplying fuel to the fuel rail 101.

Although not shown in the drawings, spark plugs are mounted in the cylinder heads 82 with their gaps extending into the recesses. These spark plugs are fired by a suitable ignition system in a known manner. An ECU, indicated generally by the reference numeral 102 is mounted on a plate 103 carried by the plenum chambers 100 for this purpose.

The drive for the intake and exhaust camshafts 88 and 94 for each of the cylinder banks will now be described by primary reference to FIG. 7. The intake and exhaust camshafts 88 and 94 of each cylinder head 82 are connected for simultaneous rotation by means of a timing chain 104 that is enmeshed with sprockets 105 and 106 formed on the intake and exhaust camshafts 88 and 94, near but not at one end thereof, respectively. This interconnection between the camshafts 88 and 94 of each cylinder head 82 permits only one of these camshafts to be driven by the crankshaft by a timing mechanism, which will be described shortly. This facilitates and simplifies the timing chain arrangement for the overall engine.

Figure 7:
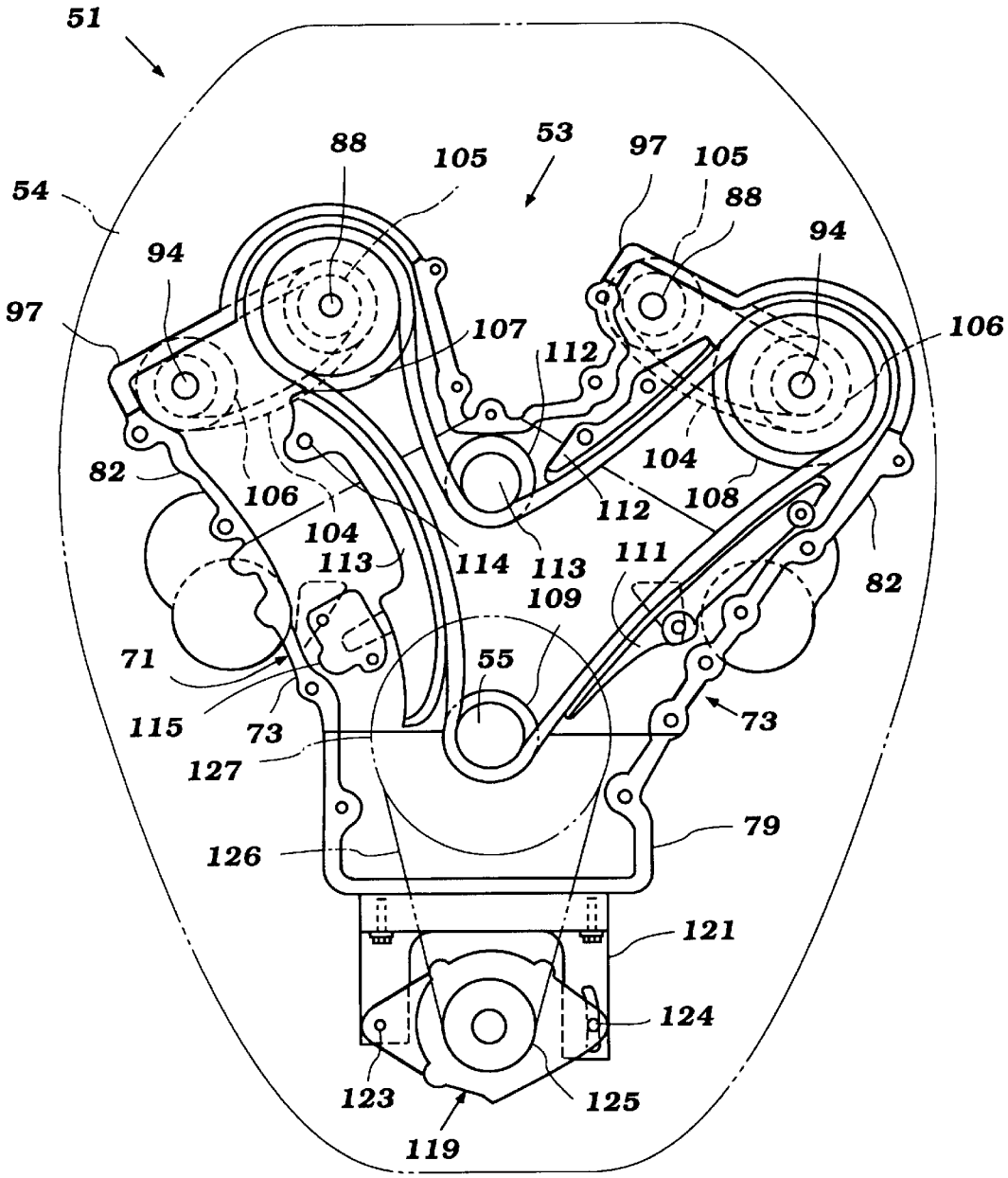
FIG. 7 is a top plan view, in part similar to FIG. 6, but shows the outboard motor engine with portions removed to show the camshaft drive arrangement.

To accomplish this drive, a driving sprocket 107, is affixed to the upper end of the intake camshaft 88 of the left-hand cylinder bank when viewed in top plan view, as seen in FIG. 7. This sprocket is held in place by a threaded fastener. In a similar manner, a timing sprocket 108 is affixed to the upper end of the exhaust camshaft 94 of the remainder cylinder head 82 by means of a threaded fastener.

As may be best seen in FIG. 7, a timing sprocket 109 is affixed for rotation with the upper end of the crankshaft 55 in an appropriate manner. This sprocket 109 has a diameter equal to one half of the diameter of the cam shaft sprockets 107 and 108 to provide the one half to one speed ratio for the camshafts 88 and 94 as is required. A timing chain 111 is trained over the crankshaft sprocket 109 and engages first the sprocket 108 of the exhaust camshaft 94 of the right-hand cylinder bank. Hence, this camshaft is driven directly from the crankshaft 55 at a one-half speed ratio, as is known in this art. As has been previously noted, the intake camshaft 88 of this cylinder bank is driven from the exhaust camshaft 94 by the timing chain 104.

From the sprocket 108, the timing chain 111 passes downwardly into the valley between the cylinder banks where it engages an idler sprocket 112 that is journaled on an idler shaft 113 and which has a smaller diameter than the sprockets 107 and 108 to maintain a compact construction. The idler shaft 113 is in the cylinder block immediately below the valley 73.

The chain 111 then turns upwardly so as to drive the timing sprocket 107 of the intake camshaft 88 associated with the remaining cylinder head 82. As has been previously noted, the exhaust camshaft 94 of this cylinder bank is driven by the timing chain 104. From the sprocket 107, the timing chain 111 returns to the crankshaft-driven sprocket 109.

A first timing chain guide rail 114 is mounted in the timing chain case formed by a timing cover 93 at the front of the cylinder block and engages the driving flight of the chain 111 to maintain it in contact with the crankshaft sprocket 109 and the exhaust camshaft sprocket 108. A similar guide rail 112 is mounted in the right-hand bank cylinder head 82 to engage the flight of the chain 111 passing between the sprocket 108 and the idler sprocket 112.

Finally, a tensioner guide 113 is pivotally supported on the remaining cylinder head 82 about a pivot pin 114. A hydraulically urged tensioner element 115 engages the tensioner guide 113 and maintains the desired tension on the trailing or return side of the drive chain 111.

Figure 4:
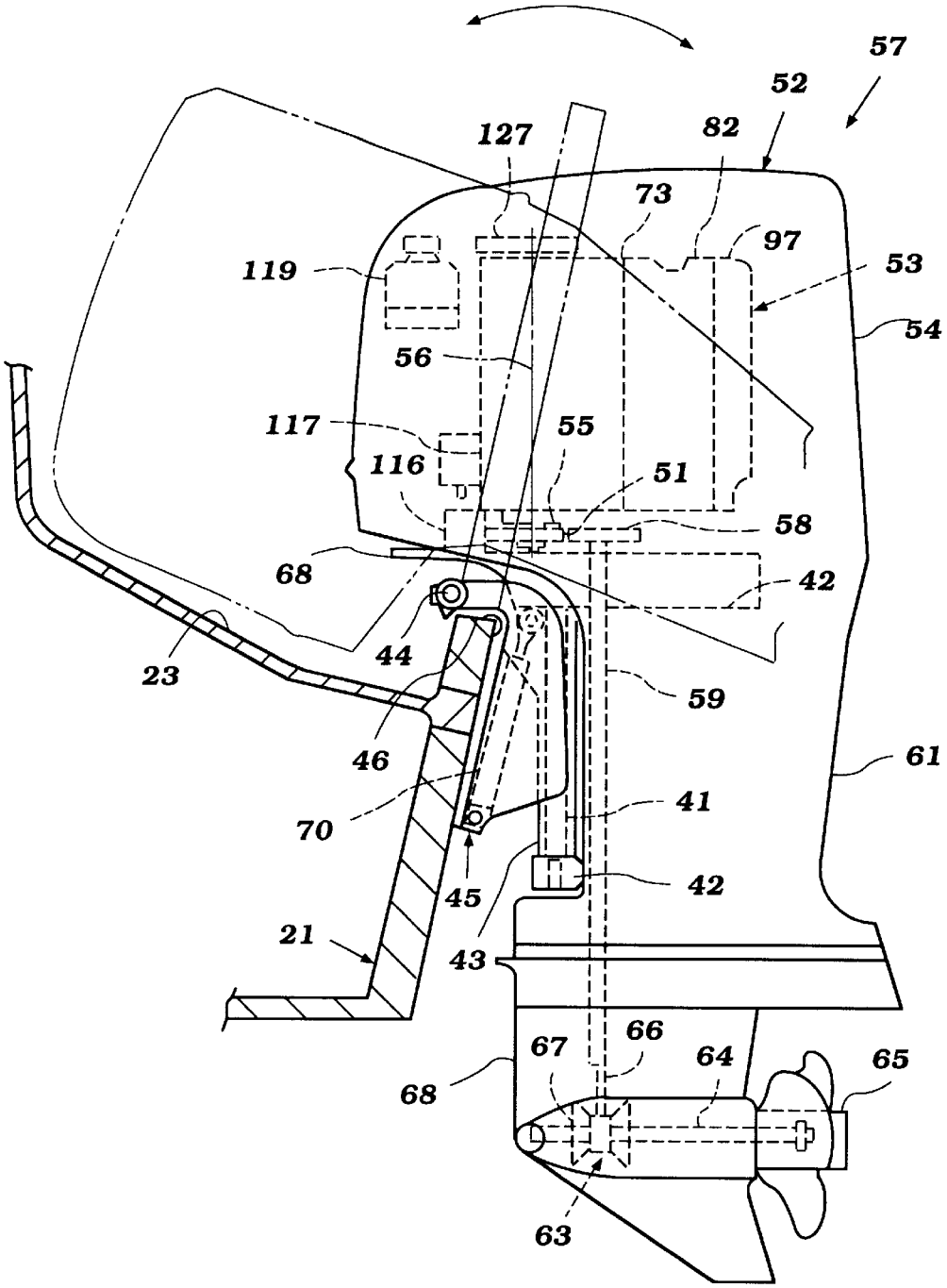
FIG. 4 is a side elevational view, in part similar to FIG. 3, and shows an outboard motor constructed in accordance with a first embodiment of the invention.

Finally, there will be described certain accessories that are related to the engine and which cooperate with it in a manner which will be described. Referring first to FIGS. 4 and 6, the engine is provided with the flywheel 116 that is fixed to the lower end of the crankshaft 55. The flywheel 116 has affixed to it a starter gear (not shown). A starter motor 117 is mounted on the front lower portion of the engine, and specifically on an extension 118 of the crankcase member 79 and in a recessed area thereof so as to provide a compact construction. The starter motor has a starter shaft to which a pinion gear is affixed for cooperation with the flywheel starter gear for starting of the engine in a well known manner.

As may be best seen in FIGS. 4–6 and 7 a further engine accessory, namely an alternator or generator 119, is mounted at the front of the engine 53 and above the starter motor 117. To this end, a mounting bracket 121 is affixed to the crankcase member 79 at the upper end of the engine by threaded fasteners. This mounting bracket 121 provides connections 123 and 124 to the alternator 119 that permit it to be adjusted. The alternator 119 is provided with a pulley 125, which is driven by a drive belt 126 from a pulley 127 affixed to the upper end of the crankshaft 55. The adjustment fasteners 123 and 124 permit the tension of the belt 126 to be adjusted in a manner well known in the art.

Figure 8:
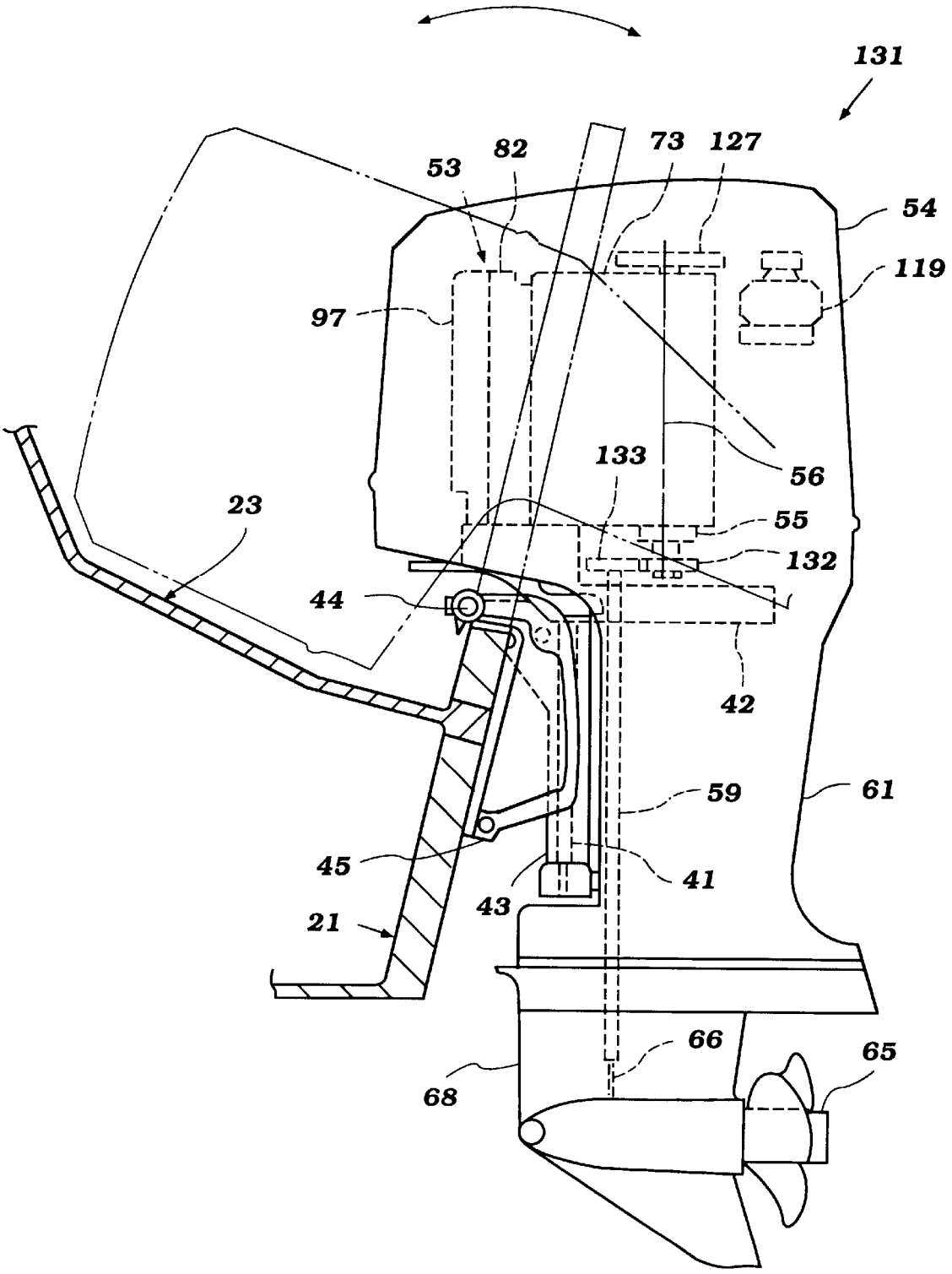
FIG. 8 is a side elevational view, in part similar to FIG. 4, and shows a second embodiment of the invention.
Figure 9:
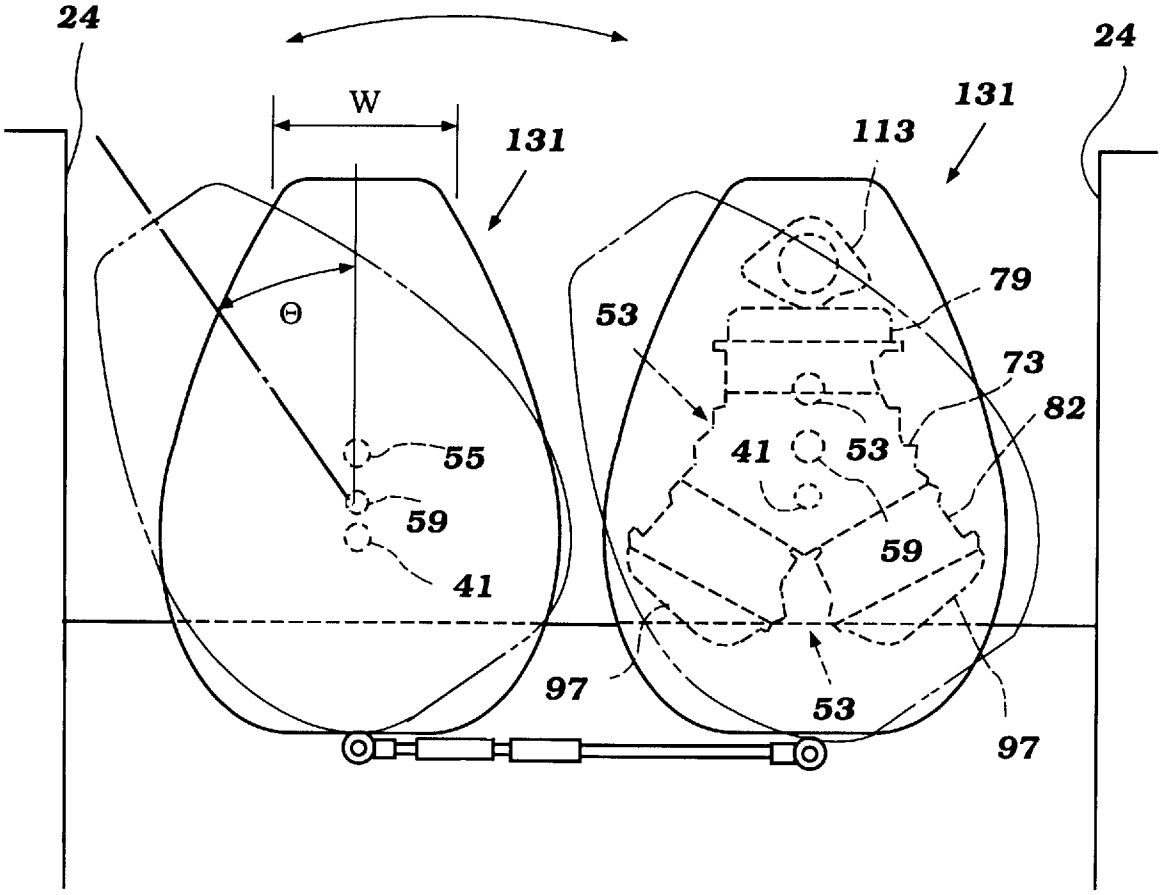
FIG. 9 is a top plan view, in part similar to FIG. 5, and shows the second embodiment of the invention and how it accomplishes the desired result.

FIGS. 8 and 9 show another embodiment of the invention which utilizes an engine which is the same in basic construction as the engine 53 of the embodiment of FIGS. 4–7. For that reason, the engine and those components associated with it which are the same as those previously described have been identified by the same reference numerals and will not be described again in detail. However, in this embodiment, the engine 53 is placed in the power head 54 in such an orientation that its crankshaft 55 rotates about an axis that is disposed to the rear of both the steering shaft 41 and its axis, and the drive shaft 59 and its axis. In other words, the engine 53 in this embodiment is rotated 180° from the position of the engine of the embodiment of FIGS. 4–8. Thus, the cylinder banks diverge in a forward direction rather than a rearward direction. Thus, as seen in top elevational view (FIG. 9), the configuration of the outboard motor, indicated generally by the reference numeral 131 in this embodiment, is such that the protective cowling 97 is wider in the front and tapers toward the rear to be narrower. Thus, the width W at the rear of the outboard motor 131 is substantially less than that of previously described embodiments. This permits an even wider rotational movement, as may be seen in FIG. 9. However, this also means that the well 23 into which the outboard motor is tilted up must be longer and deeper than with the previously described embodiments.

In this embodiment, a spur or helical gear 132 is connected to the lower end of the crankshaft 55. This gear drives a gear 133 that is affixed to the upper end of the drive shaft 59, and thus permits this offsetting arrangement.

Figure 10:
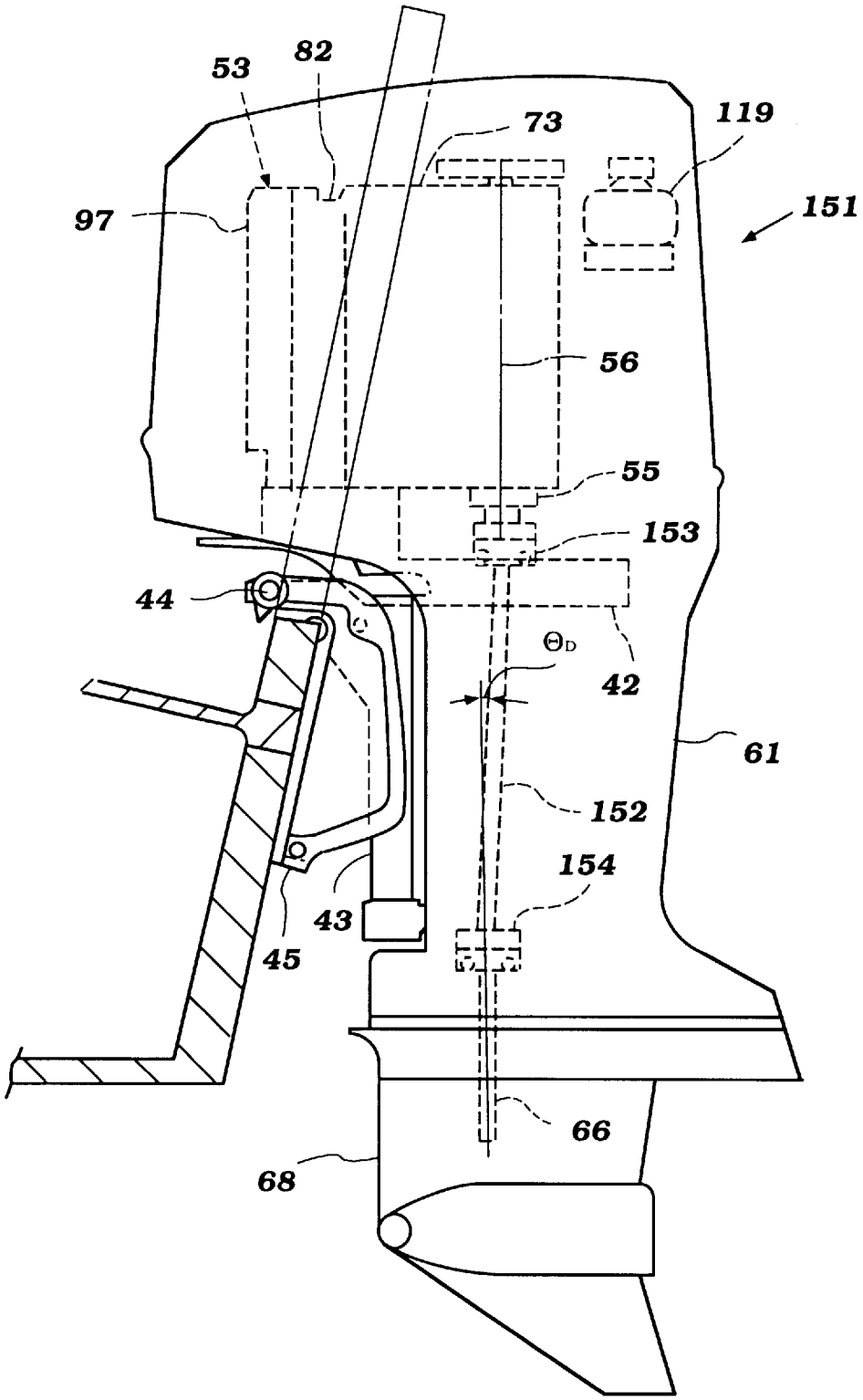
FIG. 10 is a side elevational view, in part similar to FIGS. 4 and 8, and shows a third embodiment of the invention.

An outboard motor constructed in accordance with a third embodiment of the invention is illustrated in FIG. 10 and is indicated generally by the reference numeral 151. This embodiment positions the engine 53 in the same location as that employed in the embodiment of FIGS. 8 and 9. However, with this embodiment, the transmission consisting of the intermeshing gears 131 and 132 is deleted. With this embodiment, however, the transmission input shaft, again indicated by the reference numeral 66, is maintained in its location. However, the offsetting of the axis of the crankshaft 55 to the rear of the axis of the transmission input shaft 66 is accommodated by mounting a drive shaft 152 in the drive shaft housing 61 so as to be inclined at an angle $\theta_D$ to the vertical axis of the transmission input shaft 66. Therefore, the crankshaft 55 is coupled to the drive shaft 152 through a first universal joint 153. This lower end of the drive shaft 152 is connected to the transmission input shaft 66 through a second universal joint 154. As a result, the universal joints 153 and 154 accommodate the offsetting of the axis of the crankshaft 55 relative to the transmission input shaft 66 and permit the advantageous results of the previously described embodiments to be enjoyed while eliminating the transmission gearing required by the previous embodiments.

Thus, from the foregoing description it should be readily apparent that the described embodiments of the invention are very effective in providing a compact power head assembly wherein the mounting of the engine need not be dictated by the location of the transmission input shaft, and thus it is possible to move the engine so that the power head is configured so that maximum steering with minimum obstruction from either the hull or another adjacent outboard motor is avoided. Of course, the foregoing description is that of preferred embodiments of the invention, and various changes and modifications may be made without departing from the spirit and scope of the invention, as defined by the appended claims.

What is claimed is:

1. An outboard motor comprised of a power head containing an internal combustion engine having at least one combustion chamber containing an element driven by the combustion in said combustion chamber, an engine output shaft drivingly coupled to said element for affecting rotation of said engine output shaft about a generally vertically disposed axis in response to combustion in said combustion chamber, a protective cowling encircling said engine and completing said power head, a drive shaft housing and lower unit depending from said power head and containing a propulsion device for propelling an associated watercraft, said propulsion device having a single transmission input shaft rotating about a generally vertically disposed axis, a steering shaft affixed to said drive shaft housing, a swivel bracket journaling said steering shaft for steering movement of said outboard motor about a generally vertically disposed steering axis, said transmission input shaft being disposed to the rear of said steering shaft and contiguous thereto when mounted on an associated watercraft, said engine output shaft rotating about an axis that is offset forwardly from said transmission input shaft axis and not rearwardly of said steering axis, and drive means for coupling said engine output shaft to said transmission input shaft.

2. An outboard motor as set forth in claim 1, wherein the means for driving the transmission input shaft from the engine output shaft comprises a drive shaft rotatably journaled in the drive shaft housing and lower unit about a vertically extending axis that is aligned with the axis of the transmission input shaft.

3. An outboard motor as set forth in claim 2, wherein a gear transmission drives the upper end of the drive shaft from the engine output shaft.

4. An outboard motor as set forth in claim 1, wherein the engine output shaft is disposed to the front of the transmission input shaft axis.

5. An outboard motor as set forth in claim 4, wherein the means for driving the transmission input shaft from the engine output shaft comprises a drive shaft rotatably journaled in the drive shaft housing and lower unit about a vertically extending axis that is aligned with the axis of the transmission input shaft.

6. An outboard motor as set forth in claim 5, wherein a gear transmission drives the upper end of the drive shaft from the engine output shaft.

7. An outboard motor as set forth in claim 1, wherein the engine is a V-type engine having a pair of angularly inclined cylinder banks, each forming at least one cylinder bore containing a piston element drivably coupled to a crankshaft, which crankshaft forms the engine output shaft.

8. An outboard motor as set forth in claim 7, wherein the engine crankshaft is disposed to the front of the transmission input shaft axis.

9. An outboard motor as set forth in claim 8, wherein the means for driving the transmission input shaft from the engine crankshaft comprises a drive shaft rotatably journaled in the drive shaft housing and lower unit about a vertically extending axis that is aligned with the axis of the transmission input shaft.

10. An outboard motor as set forth in claim 9, wherein a gear transmission drives the upper end of the drive shaft from the engine crankshaft.

11. An outboard motor as set forth in claim 7, wherein the engine crankshaft is disposed to the front of the transmission input shaft axis.

12. An outboard motor as set forth in claim 11, wherein the means for driving the transmission input shaft from the engine crankshaft comprises a drive shaft rotatably journaled in the drive shaft housing and lower unit about a vertically extending axis that is aligned with the axis of the transmission input shaft.

13. An outboard motor as set forth in claim 12, wherein a gear transmission drives the upper end of the drive shaft from the engine crankshaft.

* * * * *